United States Patent [19]

Tyson

[11] Patent Number: 4,533,018

[45] Date of Patent: Aug. 6, 1985

[54] LADDER SUPPORT

[76] Inventor: Sammie J. Tyson, 1501 NW. Ave. "F", Belle Glade, Fla. 33430

[21] Appl. No.: 511,483

[22] Filed: Jul. 7, 1983

[51] Int. Cl.[3] ..... E06C 7/16

[52] U.S. Cl. ..... 182/121; 248/238

[58] Field of Search ..... 182/120, 121, 122, 214, 182/107, 108; 248/238

[56] References Cited

U.S. PATENT DOCUMENTS

| | | | |
|---|---|---|---|
| 251,928 | 1/1882 | Norton | 182/214 |
| 356,457 | 1/1887 | Dudley | 182/121 |
| 407,079 | 7/1889 | Laskey | 182/121 |
| 743,899 | 11/1903 | Lynch | 182/121 |
| 1,084,034 | 1/1914 | Roberts | 182/121 |
| 1,187,437 | 6/1916 | Lucas | 182/121 |
| 1,288,182 | 12/1918 | Pool | 182/122 |
| 1,760,803 | 5/1930 | Wirth | 182/122 |
| 2,282,133 | 5/1942 | Horton | 182/121 |
| 2,432,206 | 12/1947 | Mott | 182/121 |
| 2,578,862 | 12/1951 | Tims | 182/121 |
| 3,503,468 | 3/1970 | Taylor | 182/121 |
| 4,211,307 | 7/1980 | Ethridge | 182/121 |

*Primary Examiner*—Reinaldo P. Machado
*Attorney, Agent, or Firm*—Eugene F. Malin

[57] ABSTRACT

A ladder support erectable onto a ladder for supporting workmen or materials. The ladder support includes a platform and at least two tensionable chain members. The platform is connectable in a generally horizontal position to a ladder rung, after which one chain member is interconnectable between one end of the platform and the upper adjacent ladder rung and another chain member is interconnectable either between the same end of the platform and the lower adjacent rung or the opposite end of the platform and the upper adjacent rung or both for added strength. The platform includes a lower plate connectable to the platform by screws, the mating of the two forming an elongated cavity into which a ladder rung is held. The plate mounting to the platform is adjustable so that the platform may be adjustably positioned fore and aft on the ladder rung.

2 Claims, 3 Drawing Figures

LADDER SUPPORT

BACKGROUND OF THE INVENTION

This invention relates generally to devices adapted to be connectable to ladders and more particularly to a platform easily and adjustably connectable to a ladder rung to support a workman or materials.

Prior art teaches the broad concept of devices attachable to a ladder for supporting workmen or objects. However, these devices are either very specialized dependent only upon the force of gravity for their position engagement to the ladder or very complex and expensive.

U.S. Pat. No. 47,149 discloses a scaffold requiring at least two spaced apart ladders for gravity supporting two planks which provide support. The structure is additionally complex and expensive and difficult to assemble onto the ladders.

U.S. Pat. Nos. 309,435; 606,736 and 1,452,182 ladder platforms, all of which include rigid connecting members which remain in functional communication with the ladder only by gravity force. Jarring or unexpected impact could dislodge these devices from rung engagement causing droppage or physical harm to workmen. Additionally, these structures appear complex and cumbersome or alternately lacking significant or positive adjustment.

U.S. Pat. Nos. 1,501,298 and 2,578,119 disclose more complex rigid member plank supports adapted for use between two spaced-apart ladders. Expense and assembly difficulty further limit their utility.

U.S. Pat. No. 1,772,392 teaches a holder for buckets and the like connectable to a ladder. In addition to the gravity force limitation, this invention is narrowly applicable only to cylindrical containers.

The present invention discloses a non-complex support easily interconnectable to a ladder which provides a platform for use in supporting workmen or materials such as tools or containers. The platform is adjustable fore and aft as well as pivotally to the ladder. Flexible stabilizing members are interconnectable between platform and ladder rung to insure positive engagement and platform stability independent of gravity in the preferred embodiment.

BRIEF DESCRIPTION OF THE INVENTION

A ladder support erectable onto a ladder for supporting workmen or materials. The ladder support includes a platform and at least two tensionable chain members. The platform is connectable in a generally horizontal position to a ladder rung, after which one chain member is interconnectable between one end of the platform and the upper adjacent ladder rung and another chain member is interconnectable either between the same end of the platform and the lower adjacent rung or the opposite end of the platform and the upper adjacent rung or both for added strength. The platform includes a lower plate connectable to the platform by screws, the mating of the two forming an elongated cavity into which a ladder rung is held. The plate mounting to the platform is adjustable so that the platform may be adjustably positioned fore and aft on the ladder rung.

It is an object of this invention to provide an improved adjustable and inexpensive ladder support easily connectable to a ladder for providing a support platform for workmen or material.

It is another object of this invention to provide the above ladder support which is positively engageable to a ladder.

In accordance with these and other objects which will be apparent hereinafter, the instant invention will now be described with particular reference to the accompanying drawings.

PREFERRED EMBODIMENT OF THE INVENTION

Figure 1:
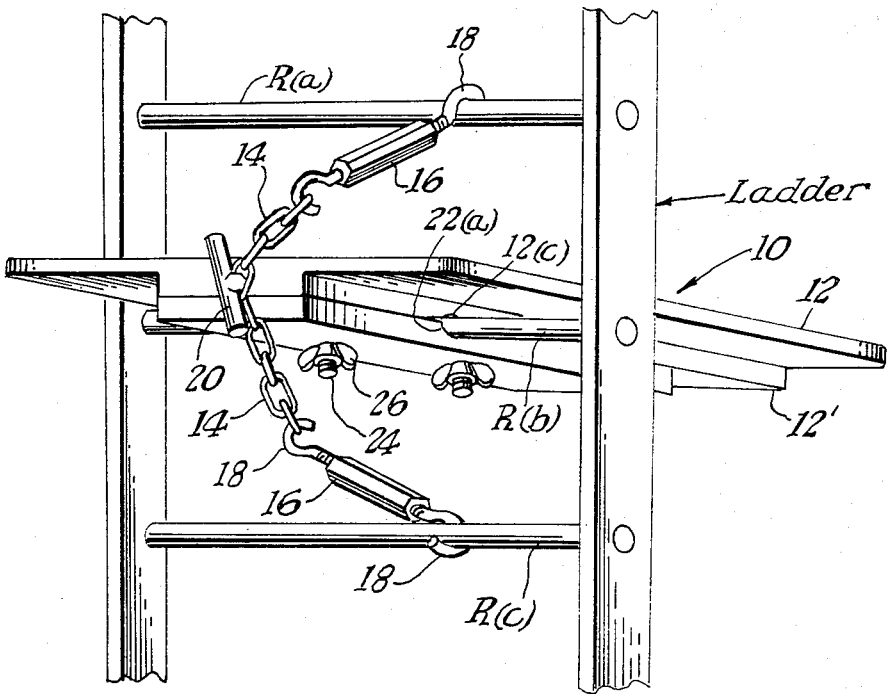
FIG. 1 is a perspective view of the invention connected to a ladder.
Figure 2:
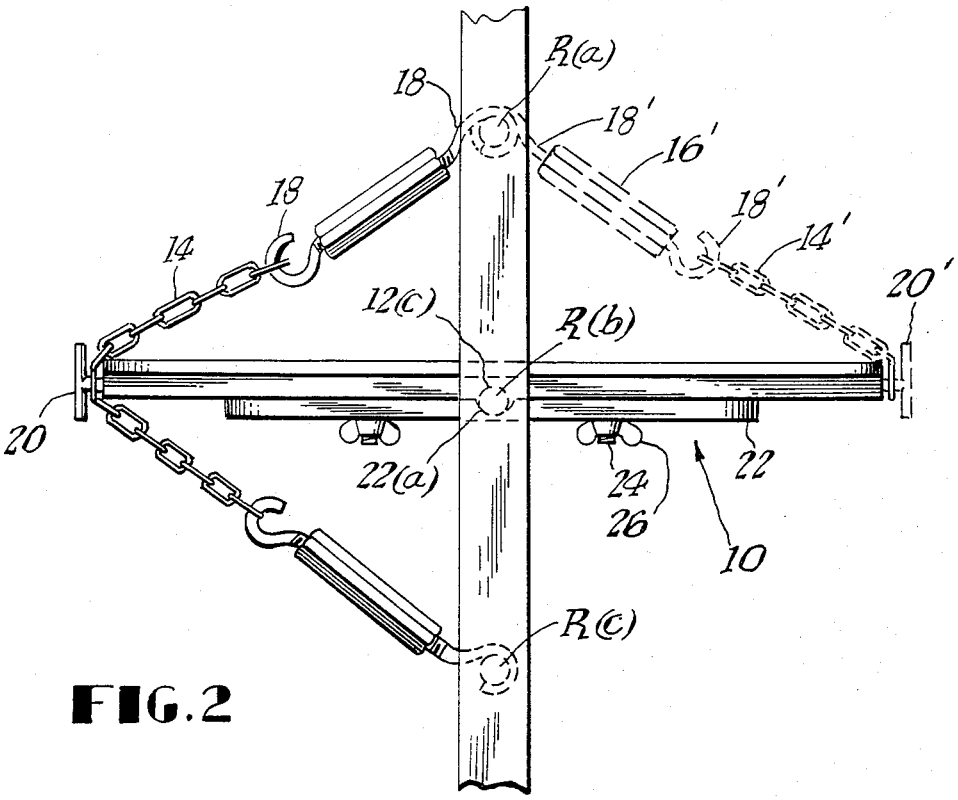
FIG. 2 is a side elevation view of the invention connected to a ladder and showing a third alternate retaining member in phantom.
Figure 3:
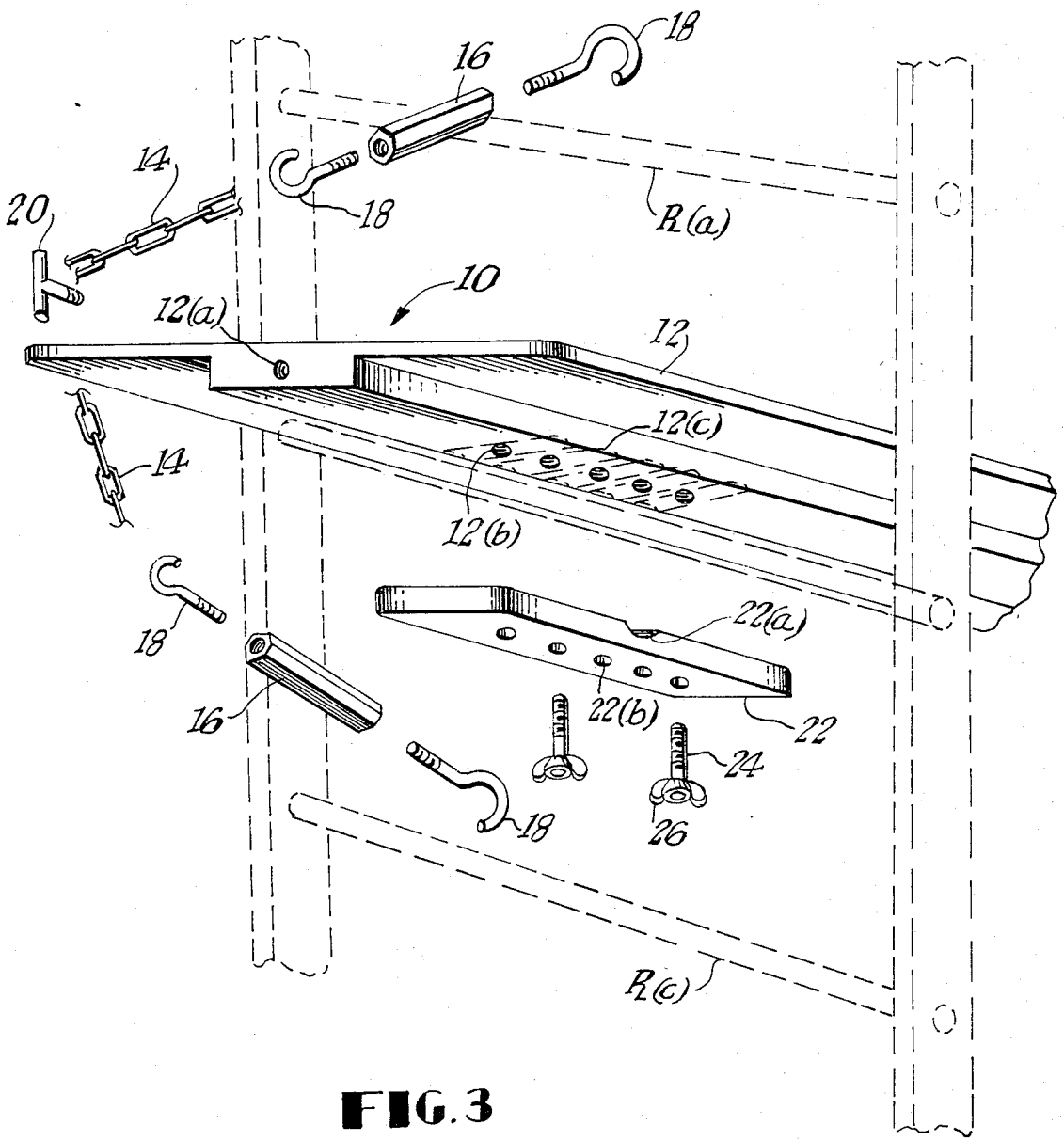
FIG. 3 is an exploded perspective view of the invention in relation to a ladder in phantom.

Referring now to the drawings, the present invention is shown generally at 10 and includes a platform 12 and at least two elongated tension members 14. The platform 12 has a thickened mid-portion 12' which mateably engages against a removable lower plate 22. The platform 12 and the lower plate 22 are held together in juxaposition as shown in FIGS. 2 and 3 by threaded fasteners 24 having thumb wings 26 adapted for hand assembly. When so mated, a generally centrally positioned transverse pocket or slot is formed by recesses 12(*c*) and 22(*a*) adapted to secure the platform 12 to a rung R(b) of the ladder as shown. This portion of the platforms connection means to a rung of the ladder provides only vertical support.

To prevent rotation of the platform 12 relative to the longitudinal axis of the rung upon which the platform 12 has been mounted, at least two elongated tension members 14 are provided. One end of each tension member 14 is connectable to one end of the platform 12 by threaded band fastener 20 which threadably engages into a mating holds 12(*c*) in the end of the platform 12, best seen in FIG. 3. The other end of each tension member 14 is connectable around a different rung R(a) or R(c), one above and below that upon which the platform has been mounted by hook 18. These books may also be in the form of snaps to prevent disengagement from the rung during assembly of the invention 10 to the ladder. Turnbuckles 16, positioned along at least one of the tension members, effects length variation and thereby controls desired platform rotational positioning and final stability adjustment of the platform. These tension members are preferably made from lengths of chain, but may also be made of cable lengths or the like.

As shown in phantom in FIG. 2, an additional tension member 14', having similar elements as the other tension members may be included for added platform stability if desired.

As first seen in FIG. 3, the platform is laterally adjustable by simply selecting the appropriate recess 12(*c*) into which to place the ring R(b). Sufficient holes 22(*b*) are provided in lower plate 22 to accommodate any available platform position.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A platform adapted for use with a ladder, said ladder being in a plane and comprising rungs disposed in said plane, wherein:

said platform comprises a means for fixing said platform means to said ladder; and a generally planer elongate support means, the plane of said support means extending transverse to said plane of said ladder, said support means having first and second ends distally opposite along the elongate length of said support means, said support means comprising a through hole means substantially mediate of said first and second ends, said through hole means adapted to surround a preselected rung of said ladder;

wherein said through hole means is selected so that said support means is free to rotate about said preselected rung absent said means for fixing, each of said first and second ends threby rotating about said preselected rung and through hole;

whereby said plane of said support means substantially extends on either side of said plane comprising said rungs of said ladder;

wherein said means for fixing comprises at least two cable means, each said at least two cable means extending between and fixed to one of said ends of said platform means and a rung of said ladder, respective ones of said at least two cable means being fixed to rungs of said ladder other than of said preselected rung;

wherein one or more of said at least two cable means comprises a turnbuckle means for adjusting the length of said at least two cable means;

wherein said support means comprises first and second elongate members joined along their elongate lengths and coincident with the elongate length of said support means as a whole, each of said first and second elongate members comprising a depression transverse to said elongate length of said support means, said first and second elongate members joined so that said depressions mate to form said through hole in said support means.

2. The platform of claim 1, wherein said at least two cable means are two are more grappling cable means.

* * * * *